United States Patent [19]

Koppenheffer et al.

[11] 4,034,178

[45] July 5, 1977

[54] ROTARY SWITCH HOUSING HAVING INTEGRAL FLEXIBLE DETENTING WALLS AND ROTOR MOUNTING STRUCTURE

[75] Inventors: Gary Jay Koppenheffer; William Henry Rose, both of Harrisburg, Pa.

[73] Assignee: AMP Incorporated, Harrisburg, Pa.

[22] Filed: June 2, 1976

[21] Appl. No.: 692,174

Related U.S. Application Data

[63] Continuation-in-part of Ser. No. 621,173, Oct. 9, 1975, abandoned.

[52] U.S. Cl. ..... 200/293; 200/11 TW; 200/291; 200/303; 200/307

[51] Int. Cl.² ..... H01H 9/02; H01H 21/00; H01H 19/00

[58] Field of Search .... 200/11 TW, 17 R, 293–296, 200/303, 291; 74/527, 568

[56] References Cited

UNITED STATES PATENTS

| | | | |
|---|---|---|---|
| 3,196,237 | 7/1965 | Westgate, Jr. | 200/303 X |
| 3,409,747 | 11/1968 | Mincone | 200/11 TW |
| 3,566,049 | 2/1971 | Wright | 200/11 TW X |
| 3,567,894 | 3/1971 | Spreitzer | 200/11 TW X |
| 3,665,127 | 5/1972 | Lockard et al. | 200/11 TW |

FOREIGN PATENTS OR APPLICATIONS

| | | | |
|---|---|---|---|
| 1,927,121 | 12/1970 | Germany | 200/11 TW |

*Primary Examiner*—James R. Scott
*Attorney, Agent, or Firm*—Gerald K. Kita

[57] ABSTRACT

The invention relates to a rotary switch of the type wherein an electrical contact is mounted on a rotor or wheel provided with circumferentially spaced and radially projecting levers. The wheel is normally retained in fixed position within a housing by a pair of resiliently deflectable webs engaged against at least a pair of levers. This construction of the switch requires a minimum of component parts and assembly steps.

3 Claims, 9 Drawing Figures

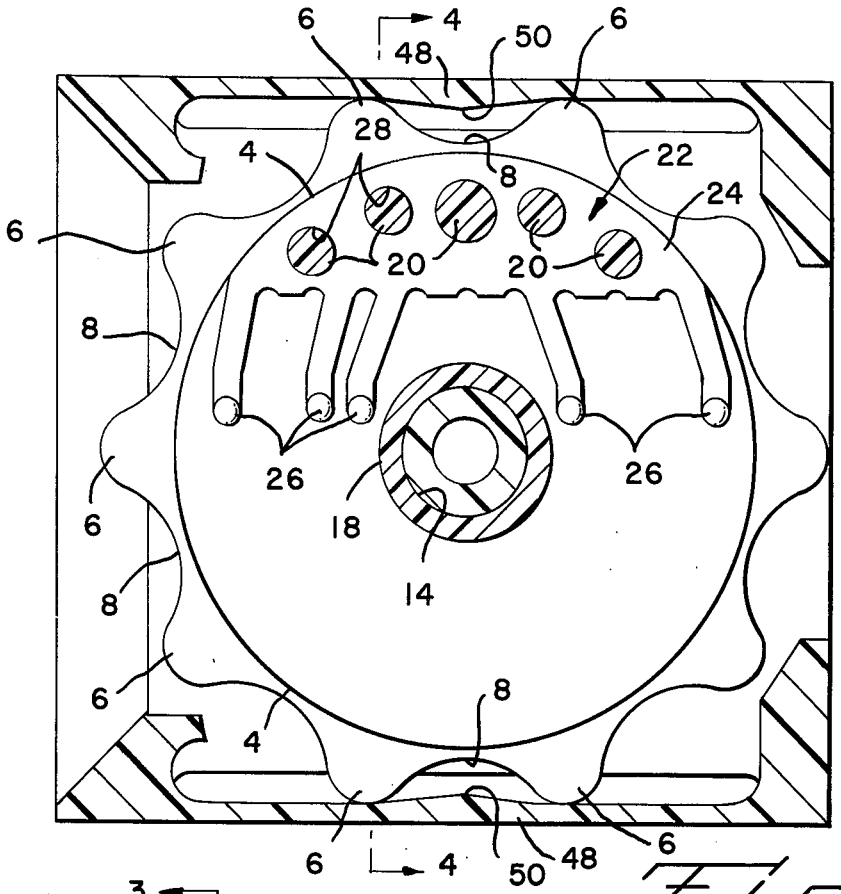
Fig. 3
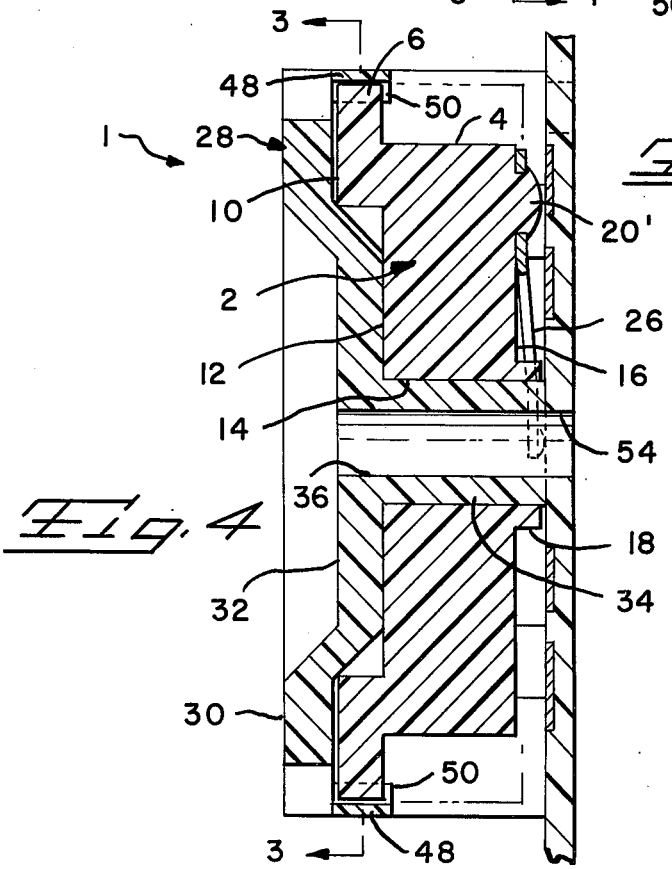
Fig. 4
Fig. 5
| BCD POSITION | C | | | |
|---|---|---|---|---|
| | A | B | E | D |
| 0 | | | | |
| 1 | ○ | | | |
| 2 | | ○ | | |
| 3 | ○ | ○ | | |
| 4 | | | ○ | |
| 5 | ○ | | ○ | |
| 6 | | ○ | ○ | |
| 7 | ○ | ○ | ○ | |
| 8 | | | | ○ |
| 9 | ○ | | | ○ |

ROTARY SWITCH HOUSING HAVING INTEGRAL FLEXIBLE DETENTING WALLS AND ROTOR MOUNTING STRUCTURE

CROSS REFERENCE TO RELATED APPLICATION

This application is a continuation-in-part application of Ser. No. 621,173, filed, Oct. 9, 1975 now abandoned.

The invention relates to a rotary switch of the type wherein an electrical contact is mounted on a rotor or wheel provided with circumferentially spaced and radially projecting levers. The wheel is normally retained in fixed position within a housing by a pair of resiliently deflectable webs engaged against at least a pair of levers. The wheel is indexed to another retained position upon forcible rotation of the wheel. Levers are rotated to engage and forcibly deflect the webs allowing rotation of the wheel until each web again engages two of the levers. The switch housing is provided with an opening therethrough exposing one of said levers for manual actuation by an operator of the switch. As the lever is actuated to turn the wheel another lever is rotated into position for exposure at the housing opening. This construction of the switch requires a minimum of component parts and assembly steps.

OBJECTS

Accordingly it is an object of the present invention to provide a manually actuated rotary switch having a minimum number of component parts wherein a housing of the switch also provides for resilient retention of a rotor of the switch in desired position.

Another object of the present invention is to provide a manually actuated rotary switch wherein a housing of the switch includes resiliently deflectable detents for maintaining a rotor of the switch in a desired fixed position.

Another object of the present invention is to provide a manually actuated rotary switch wherein a rotor of the switch is provided with radially projecting levers which are each exposed in turn through an opening of a housing of the switch upon rotation of the rotor and wherein the switch housing is provided with resiliently deflectable detents each normally engaged on a pair of levers to restrain rotation of the rotor.

Other objects and many attendant advantages of the present invention will become apparent from the perusal of the following detailed description taken in conjunction with the accompanying drawings.

BRIEF DESCRIPTION OF THE DRAWINGS

FIG. 3 is an enlarged elevation in section of the switch illustrated in FIG. 1.

FIG. 4 is an enlarged elevation in section of the switch components of FIG. 1 mounted on the substrate of FIG. 2.

FIG. 5 is a truth table of the switching functions of the switch illustrated in the drawings.

BRIEF DESCRIPTION OF THE INVENTION

Figure 1:
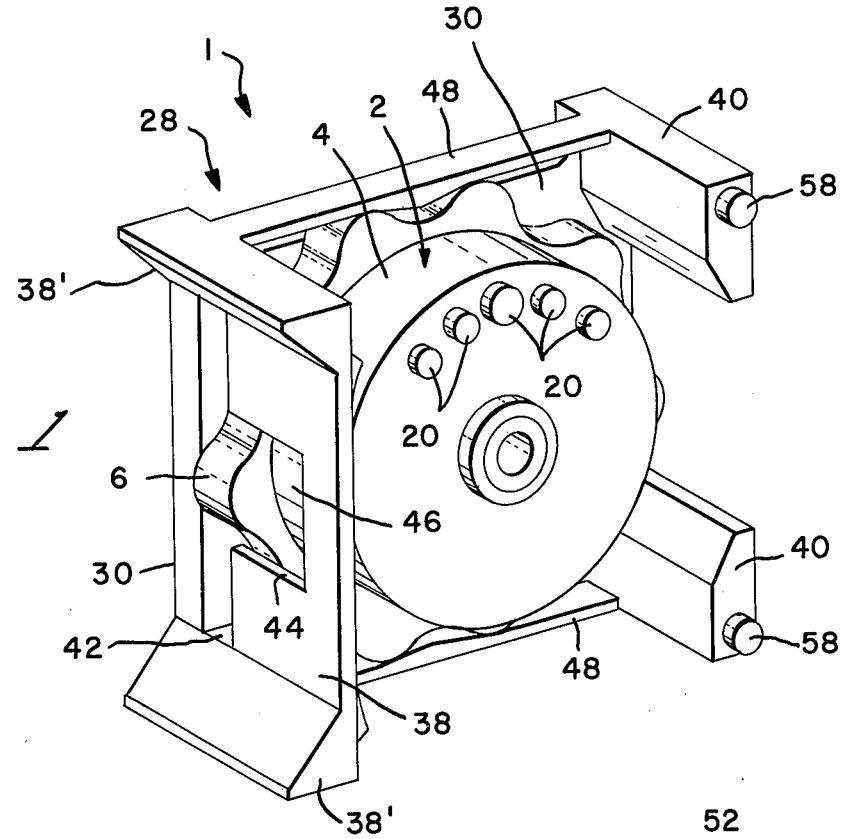
FIG. 1 is an enlarged perspective of switch components according to the present invention.

With more particular reference to the drawings there is shown in FIGS. 1, 3 and 4 component parts of a switch according to the present invention. The switch includes a generally cylindrical wheel or rotor 2, the cylindrical periphery 4 of which is provided with a plurality of circumferentially spaced and radially projecting levers 6 with arcuate indentations 8 defined between each adjacent pair of levers 6. The fingers are adjacent one side 10 of the rotor 2 which is provided with an enlarged cylindrical shallow recess 12. The rotor 2 is provided with a central cylindrical bore 14 communicating with the recess 12 and with a circular side 16 of the rotor 2. A generally cylindrical hub 18 projects outwardly of the side 16 and encircles the bore 14. The side 16 further is provided with a plurality of integral projecting studs 20. The rotor 2 with all the parts thereof is advantageously molded into a unitary dielectric component part of the switch.

As shown in FIGS. 3 and 4 the present invention further includes a metal contact 22 having a body portion 24 provided with integral projecting cantilever leaf springs or contact fingers 26. Body portion 24 is provided with suitable apertures 28 receiving the studs 20 therein for mounting the contact 22 onto the circular side 16 of the rotor 2. As shown in FIG. 4 the studs 20 are then peened, each thereby provided with an enlarged head 20' overlying and retaining the contact 22 in place. The contact fingers 26 then project outwardly diagonally in cantilever fashion from the face or side 16 of the rotor 2. The rotor is mounted within a dielectric housing 28. More particularly the housing 28 includes an end wall 30 which is relatively recessed at 32 to form a cup. With the rotor 2 mounted in the housing the cup 32 projects into and is captivated in the recess 12 of the rotor and rotatably engages against the bottom wall of the recess 12 thereby supporting the rotor for rotation in the housing. The bottom wall cup portion 32 further is provided with an integral projecting axle 34 having a central bore 36 therethrough. The bore 14 rotatably receives the axle 34. The housing 28 includes a first sidewall 38 projecting generally normally to the bottom wall 30 and having wedge-shaped projecting flanges 38'. The housing further includes a pair of corner posts 40 projecting normally from the bottom wall 30. The sidewall 38 and the posts 40 are advantageously molded integral with the bottom wall 30 of the housing and define a relatively open housing interior area receiving the rotor 2. It is to be understood that the housing interior area may also be fully enclosed as desired merely by substituting additional sidewalls on the housing surrounding the rotor 2.

A portion of the side wall 38 is provided with an opening in the form of an elongated slot 42 receiving one of the levers 6 protruding outwardly from the interior of the housing. A window portion 44 communicating with the slot 42 is also provided in the sidewall 38 to expose a portion 46 of the cylindrical periphery 4 of the rotor 2 such that indicia (not shown) on the cylindrical periphery 4 may be viewed through the window 42.

As shown more particularly in FIGS. 1 and 3, the housing portions 28 is provided with a pair of opposed integral and elongated web portions 48. The web portions 48 are molded integrally with and extend between the sidewall 38 and a corresponding post 40. Each of the webs 48 is in spaced relationship from the bottom wall 30 of the housing. Each web portion comprises a relatively thin resilient portion of the housing providing a detent for the switch rotor 2 retaining the same in desired fixed position within the housing 28. More particularly, each web 48 in its normal operation engages two of the levers 6. Since the webs 48 are on opposite sides of the rotor the rotor is sandwiched between the two webs and is retained in fixed position with the housing. Each web 48 further includes a relatively thickened portion or projecting portion 50 which projects into a corresponding recess between the corresponding engaged levers 6. Normally each projecting portion 50 centers the two levers 6 which straddle the projecting portion The switch rotor is selectively rotated or indexed to another retained position in the following manner. Normally one of the projecting levers 6 is exposed through the opening 42 of the housing wall 38 for manual actuation by an operator of the switch. As the switch rotor is rotated one of the levers 6 is rotated first into engagement with a corresponding web portion 48. Continued rotation of the rotor causes the lever 6 to forcibly and resiliently deflect a corresponding web portion 48 outwardly away from the rotor to allow rotation of the lever past the web portion. As the lever is rotated past the web portion 48 it impinges forcibly against the projecting portion 50 of the web concentrating the outward force on the web at that location to insure outward deflection of the web. Once a lever is rotated past the web, the web resiliently returns to its normal position shown in FIG. 3 and into engagement on a pair of levers to retain the switch in a new position within the housing. Advantageously the detent mechanism for restraining rotation of the rotor is fabricated as a unitary part of the housing thereby minimizing the number of component parts required for a rotary switch. As shown the webs 48 comprise only segments of housing sidewalls partially enclosing opposite sides of the rotor. The webs optionally may comprise larger sidewalls of the switch housing for stronger detent of the rotor. Additional sidewalls may be added to the housing to enclose the rotor.

Figure 2:
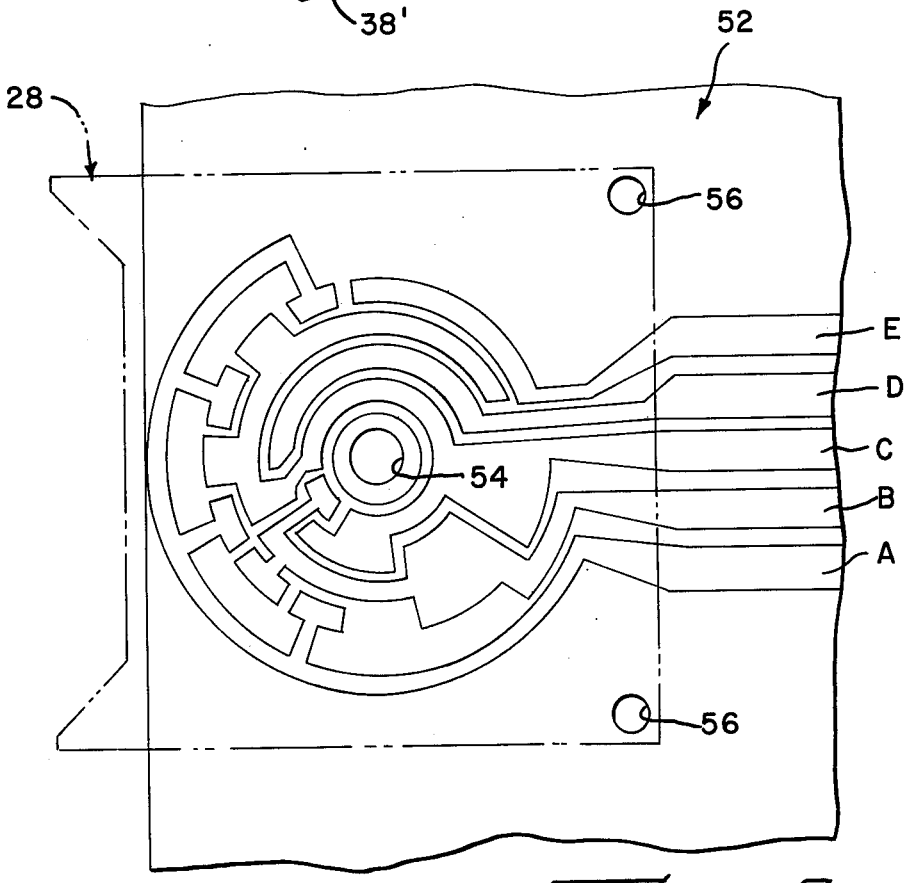
FIG. 2 is an enlarged fragmentary plan of a substrate according to the present invention on which the component parts of FIG. 1 are mounted.

FIG. 2 illustrates a printed circuit board for substrate 52 having circuit paths A, B, C, D, and E thereon. The paths are arranged in a concentric circular pattern about a central mounting aperture 54. Additional apertures 56 are provided in the substrate. As shown in FIGS. 2 and 4 the housing 28 together with the rotor 2 and the contact 22 are mounted on the substrate 52 as shown. Each post 40 includes a projecting mounting stud 58 received in a corresponding aperture 56 of the substrate thereby mounting and aligning the housing 28 on the substrate 52. The housing 28 is attached to the substrate for example by peening the studs 58 to form enlarged heads (not shown).

FIG. 4 illustrates the aperture 54 in alignment with the board 36 to receive therein a suitable elongated fastening device (not shown) further utilized to mount the housing and rotor to the substrate. As shown the substrate is larger then the peripheral outline of the housing 28. Yet it is to be understood that any size substrate other than specifically shown may be utilized. With reference to FIG. 4 the contact fingers 26 project diagonally toward the substrate and are resiliently compressed thereagainst with the housing mounted to the substrate as described. As the rotor is selectively actuated the contact fingers selectively engage and bridge across the circuit paths A, B, C, D, and E according to the truth table shown in FIG. 5. Any other suitable contact configuration and circuit path pattern of the substrate is intended to be interchangeable with the specific embodiments shown and described in FIGS. 1–9.

Figure 6:
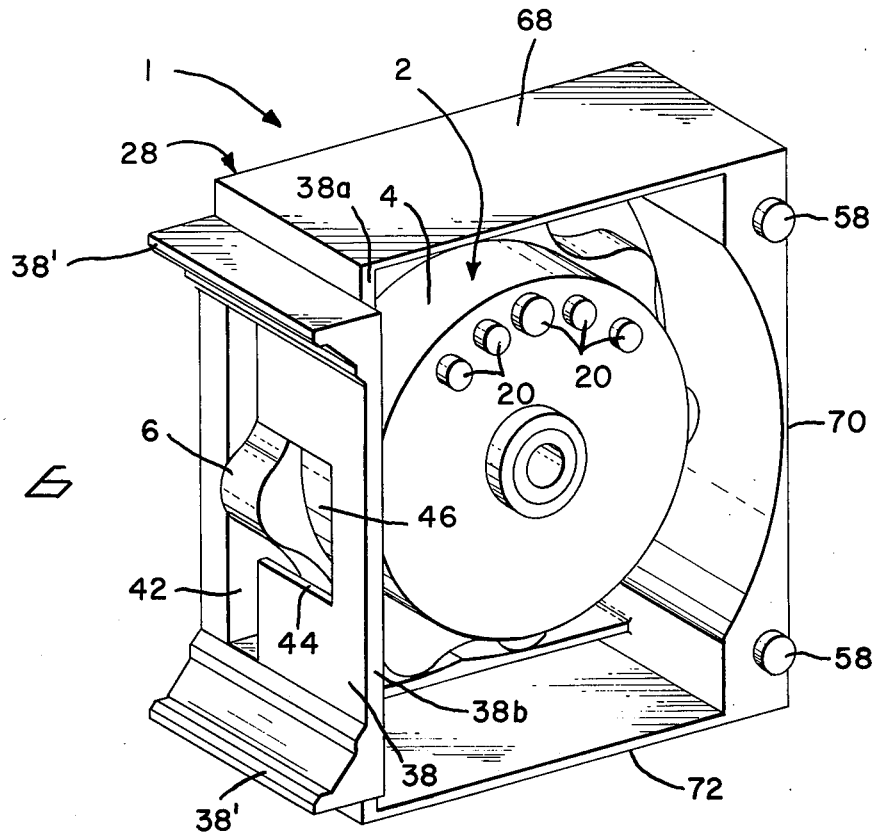
FIG. 6 is an enlarged perspective of another preferred embodiment of a switch according to the present invention.
Figure 7:
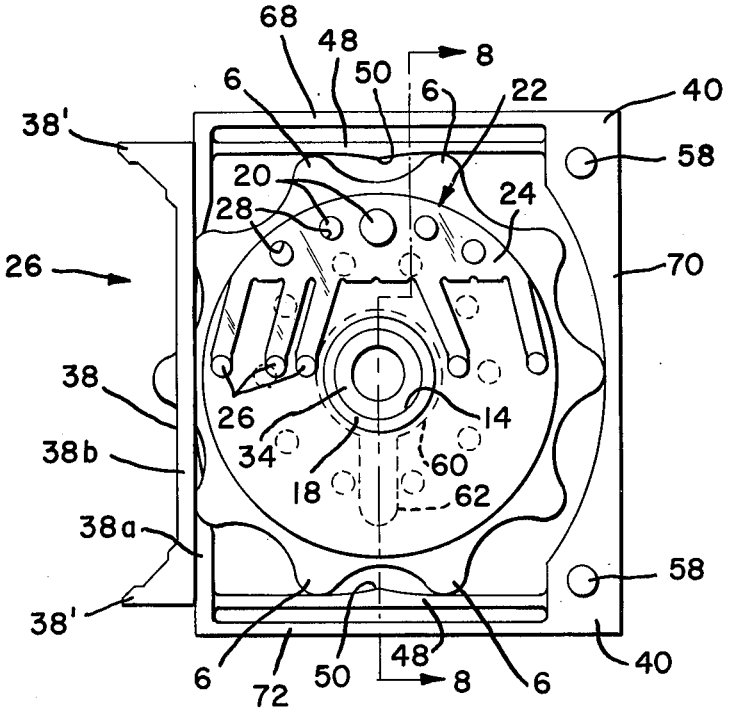
FIG. 7 is an enlarged elevation of the switch shown in FIG. 6.
Figure 8:
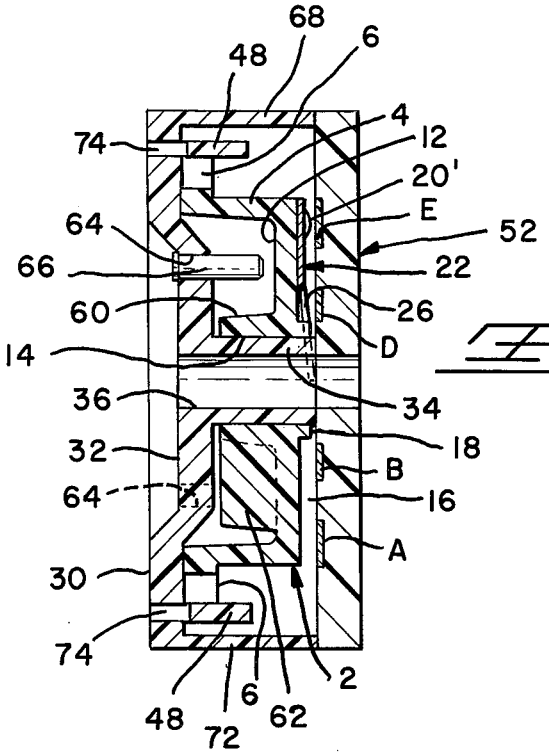
FIG. 8 is a section taken along the line 8—8 of FIG. 7.

FIGS. 6, 7 and 8 illustrate another preferred embodiment of a switch wherein like numbers refer to similar parts as between the embodiments of FIGS. 6 and 1. The embodiment of FIG. 6, more particularly illustrated in FIG. 8, shows the housing 28 includes an end wall 30 which is relatively recessed at 32 to form a cup portion, similar to the embodiment of FIG. 1. With the rotor 2 mounted in the housing the cup portion 32 projects into and is captivated in the recess 12 of the rotor. However the cup portion is not engaged against the wall 16 of the rotor as in the embodiment of FIG. 1. Instead the recess 12 is relatively deep to define a clearance space between the cup portion 32 and the end wall 16 of the rotor. Within such clearance space the rotor is provided with a relatively thin wall hub 60 encircling the bore 14 and provided with an integral radially projecting appendage 62 shown more particularly in FIGS. 7 and 8. The appendage 62 is pivoted about the axle 34 of the cup portion 32 as the rotor also is rotated about the axle 34. In addition the cup portion 32 further is provided with a plurality of spaced apertures 64 therethrough, which apertures are equally radially spaced about the central bore 36 of the axle 34. As shown more particularly in FIG. 8 an optional pin 66 may be mounted in a selected aperture 64 such that the pin projects into the clearance space defined by the recess 12 providing a stop against which the appendage 62 becomes engaged, upon rotation of the rotor 2 to limit further rotation of the rotor. As shown the cylindrical outer periphery 4 is of relatively thin wall construction and is supported slidably against the bottom wall 30 upon rotation of the rotor. Provision of the pin 66 is optional.

As before disclosed, the housing interior area may fully enclose the rotor 2. This is accomplished by providing additional sidewall portions 68, 70 and 72 projecting normally outward from the bottom wall 30. As shown the sidewall portions are integrally joined with the corner posts 40 and with the first sidewall 38. Thus in effect a continuous quadrilateral sidewall encloses the rotor 2 and is molded integral with the bottom wall 30. As shown more particularly in FIG. 8 the web portions 48 are molded integrally with and extend between the sidewalls 38 and corresponding post portions 40 now considered as thickened end portions of the sidewall 70. The web portions 48 are spaced from the bottom wall 30 of the housing. This is accomplished by providing elongated slots 74 through the bottom wall 30 extending contiguous with the entire lengths of the web portions 48. During molding, elongated mold core pins are disposed through the wall 30 and thereby form the slots 74 to allow mold formation of the web portions 48 in spaced relationship from the wall 30. By similar molding techniques, the web portions 48 also are in spaced relationship respectively from the walls 68 and 72. Each web portion 48 further includes a relatively thickened central portion 50 which projects into a corresponding recess between the corresponding engaged levers 6. In addition each web portion is tapered from the relatively thickened portion 50 toward each of its ends which are joined integrally to the walls 38 and 70. The tapered configurations provide smooth bearing surfaces over which corresponding engaged levers 66 may be slidably traversed upon rotation of the rotor. Thus the function of the web portions 48 and the thickened 50 thereof is the same in each of the embodiments disclosed.

As shown in FIGS. 6 and 7 the sidewall 38 further is provided with a relatively recessed edge 38*a* which is in alignment with the edges of the remaining sidewall portions 68, 70 and 72 which support the planar printed circuit board or substrate 52 as shown in FIG. 8. The sidewall 38 further is provided with a raised edge portion 38*b* projecting outwardly beyond the edge portion 38*a* and therefore beyond the edges of the sidewall portions 68, 70 and 72 providing a stop means for the edge of the printed circuit board mounted over the edges of the sidewall portions 68, 70, 72 and 38*a*. Normally the sidewall portion 38*b* and the flange portion 38′ extend outwardly beyond the edge of the sidewall portion 38*a* a distance equal to the thickness of the printed circuit board or substrate 52.

Figure 9:
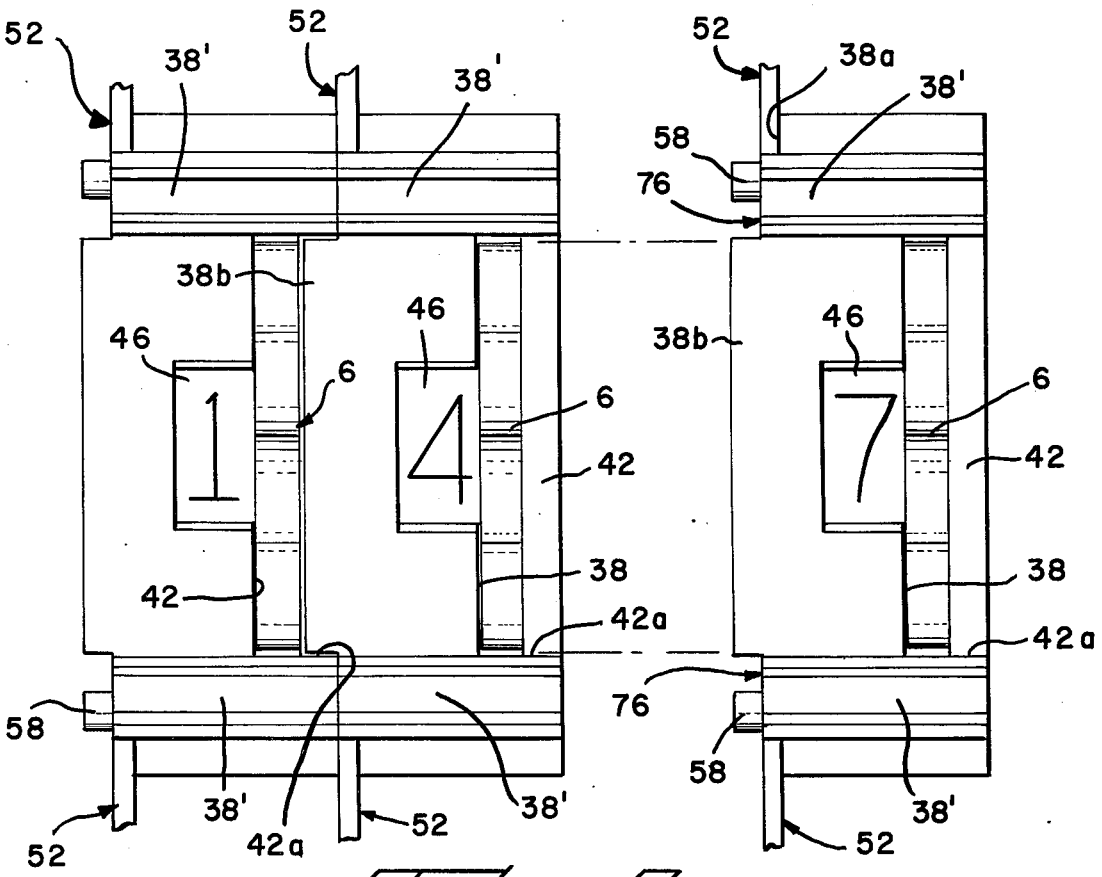
FIG. 9 is an enlarged fragmentary elevation in section illustrating a plurality of switches in interlocked relationship.

FIG. 9 illustrates another preferred embodiment which is a slight modification of the embodiment shown in FIG. 6. In this embodiment only the flanges 38′ extend out a distance beyond the edge of the wall portion 38*a* a distance equal to the thickness of the substrate 52. This is shown at 76. The sidewall portion 38*b* spanning between the flanges 38′ extends outwardly even further beyond the thickness of the substrate 52 and outwardly beyond the edges of the flanges 38′ which are shown at 76. The projecting sidewall portion 38*b* thus provides a projecting tab for interlocked engagement with a similar housing. More particularly the tab 38*b* interlocks within a notched or cut away portion 42*a* of the bottom wall 42 which extends the distance between the flange portions 38′. Thus when two housings are interlocked together the sidewall portion 38*b* of one housing interlocks within a notched portion 42*a* of an adjacent housing and interfits between the flange portions 38′ of an adjacent housing and is disposed thereby adjacent to the corresponding slot 42. In addition the provided studs 58 of one housing will interlock within recesses (not shown) which are correspondingly provided in the bottom wall 42 of an adjacent housing. In this manner any desired number of similar housings may be interlocked together with sufficient clearance defined between adjacent housings to allow for a printed circuit board 52 therebetween, which may be of any desired size, either confined within the adjacent housings or projecting outwardly of the housings as desired.

Although preferred embodiments of the present invention are described in detail, other embodiments and modifications thereof which would be apparent to one having ordinary skill in the art are intended to be covered by the spirit and scope of the appended claims.

What is claimed is:

1. In a rotary switch having moveable electrical contacts mounted on a rotor provided with radially projecting levers and a housing substantially enclosing the rotor and contacts, and the housing enclosing detent means engageable on said rotor, the improvement comprising:

said housing and said detent means being fabricated in one piece from a dielectric material, said housing having a base wall rotatably supporting said rotor and a plurality of sidewall portions integral with and projecting outwardly of said base wall, said detent means comprising a pair of elongated and relatively thin and resilient web portions each integrally joined at opposite ends to opposed ones of said sidewall portions, said web portions extending between said opposite ones of said sidewall portions and resiliently engaging selected levers of said rotor which is disposed between said web portions, said base wall having therein slots extending lengthwise of said web portions for formation of said web portions in spaced relationship from said base wall, and axle means rotatably mounting said rotor on said base wall.

2. The structure as recited in claim 1, wherein, said axle means is integral with said base wall and projects outwardly therefrom.

3. The structure as recited in claim 2, wherein, said axle means and said base wall are provided therethrough with a common aperture.

* * * * *